US005692583A

United States Patent [19]

Reed et al.

[11] Patent Number: 5,692,583

[45] Date of Patent: Dec. 2, 1997

[54] HANDLING DEVICE FOR RAILWAY WHEEL ASSEMBLIES

[75] Inventors: Greg A. Reed, Acworth; Larry T. Goodwin, Canton, both of Ga.

[73] Assignee: Norfolk Southern Railway Co., Norfolk, Va.

[21] Appl. No.: 621,233

[22] Filed: Mar. 25, 1996

[51] Int. Cl.[6] ..... B66F 9/12

[52] U.S. Cl. ..... 187/237; 414/607

[58] Field of Search ..... 787/237, 222, 787/219, 220, 221; 414/607, 427

[56] References Cited

U.S. PATENT DOCUMENTS

| | | | |
|---|---|---|---|
| 2,362,991 | 11/1944 | Dahl | 414/607 |
| 2,699,878 | 2/1955 | Avery | 414/607 |
| 3,489,305 | 1/1970 | Palmateer | 414/607 |
| 3,556,328 | 1/1971 | Miles et al. | 414/607 |
| 3,850,322 | 11/1974 | Miles et al. | 187/237 |
| 4,065,015 | 12/1977 | Radakovich | 187/237 |
| 4,669,949 | 6/1987 | Sutton | 414/607 |
| 4,688,981 | 8/1987 | Ravnsborg et al. | 414/607 |
| 5,022,811 | 6/1991 | Wallman | 414/607 |

FOREIGN PATENT DOCUMENTS 1 925 603 8/1970 Germany .

*Primary Examiner*—Kenneth Noland

*Attorney, Agent, or Firm*—Watson Cole Stevens Davis, P.L.L.C.

[57] ABSTRACT

The handling device is mounted on the lifting blades of a forklift truck and held in position by a safety chain. A frame includes a pair of spaced support members adapted to support the wheels of a wheel assembly therebetween. A removable adapter bar is stored on a stop plate of the frame when larger wheeled assemblies are handled, and may be moved to the outer ends of the support members when smaller wheeled assemblies are handled, in which case the bearing races at the ends of the wheel assembly are supported on conventional bearing race adapters which are supported on the stop plate and the adapter bar. The adapter bar is retained on the stop plate by a pair of spaced plates and a pin on the adapter bar which is received in a hole in the stop plate. The adapter bar is retained at the outer ends of the support members by a pair of spaced plates on one support member and a hole in the other support member which receives the pin on the adapter bar.

19 Claims, 4 Drawing Sheets

HANDLING DEVICE FOR RAILWAY WHEEL ASSEMBLIES

BACKGROUND OF THE INVENTION

The present invention relates to a handling device which is adapted to be mounted on the lift blades of a conventional forklift truck. The handling device is especially adapted for lifting and transporting railway wheel assemblies from one point to another. Such railway wheel assemblies generally include an axle having a pair of railway wheels mounted thereon, the opposite ends of the axle being surrounded by roller bearing races. A conventional railway car such as an articulated stack or spine car is in turn supported on conventional adapters which rest on the roller bearing races.

It is necessary to replace the railway wheel assemblies after a certain amount of use. When it is desired to replace a railway wheel assembly, a suitable hydraulic jack system is employed for jacking up the railway car while leaving the railway wheel assembly on the underlying tracks. It is desirable to provide a handling device mounted on the lifting blades of a forklift truck so that the handling device can be moved into position to engage and lift the the wheel assembly off of the tracks a sufficient distance so that the flange of the railway wheels will clear the tracks. The handling device can then be moved laterally away from the tracks by the forklift truck and then moved to a suitable location where the wheel assembly can be lowered into a suitable rack or the like. The handling device can then be maneuvered into position to lift a new wheel assembly onto the device, whereupon the new wheel assembly can be moved into position on the tracks under the jacked up railway car. The railway car can then be lowered onto the new wheel assembly.

The railway wheel assemblies in use include wheels of different diameters, most commonly 33 inch, 36 inch and 38 inch diameter wheels. In some cases 28 inch diameter wheels may be encountered. It is therefore desirable to provide a handling device which can successfully be employed with wheels of such different diameters. Prior art handling devices have proved to be unsatisfactory for a number of reasons. They may not be capable of effectively handling wheels of all the different diameters as discussed above. Furthermore, such prior art devices pose the risk of injury to persons operating the equipment. Additionally, prior art handling devices are complicated and expensive in construction.

SUMMARY OF THE INVENTION

The present invention incorporates a structure which permits an operator to easily insert the lifting blades of a forklift truck into the frame of the device. A pair of spaced support portions are adapted to effectively support railway wheel assemblies having the three larger diameter railway wheels discussed above, the wheel assemblies being properly positioned on the support portions by a stop means which assures that the wheel assemblies are supported inwardly of the outer ends of support portions.

When a wheel assembly having smaller wheels of 28 inch diameter is to be handled by the device, an adapter bar is moved from a stored position on the stop means of the device to a railway wheel assembly supporting position wherein the adapter bar extends between the outer ends of the support portions. In this mode of operation, the roller bearing races of the wheel assembly are supported on conventional roller bearing race adapters which in turn are supported on the stop means and the adapter bar. In this manner, wheel assemblies of all sizes may be successfully handled by the device.

When wheel assemblies having larger wheels are again to be handled, the two roller bearing race adapters are removed and the adapter bar is returned to stored position whereupon the spaced support portions are again adapted to support the larger wheels of such wheel assemblies as previously discussed.

The invention handling device can be operated by one man and is very safe to use. The possibility of injury to operating personnel is reduced to a minimum. Furthermore, the device is relatively simple and inexpensive in construction, yet is efficient and effective in operation.

DESCRIPTION OF THE PREFERRED EMBODIMENT

Figure 1:
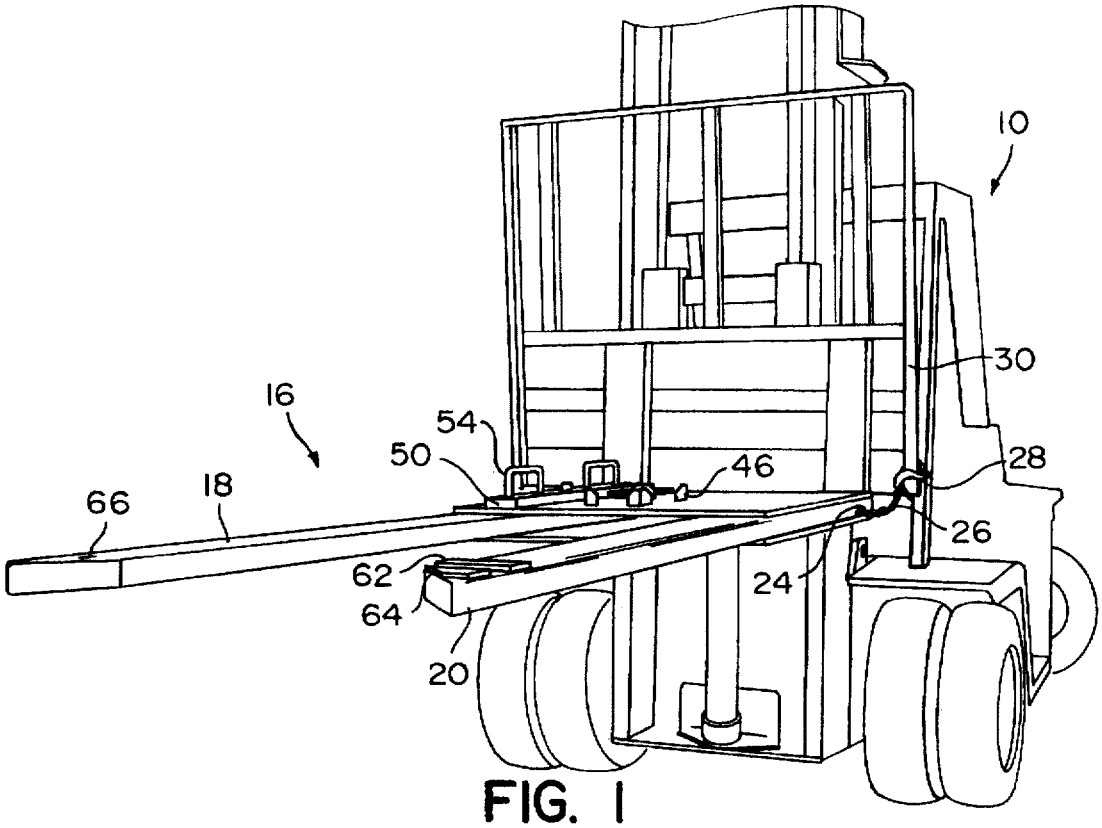
FIG. 1 is a front perspective view of a forklift truck with the handling device mounted on the lifting blades thereof.
Figure 2:
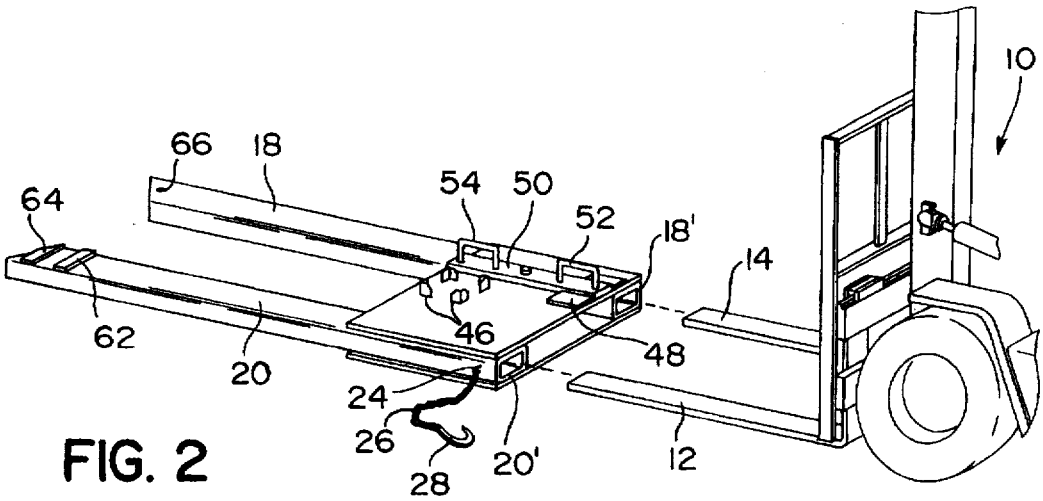
FIG. 2 is a top rear perspective view showing the handling device resting on the ground with a forklift truck aligned therewith for mounting the device on the lifting blades of the truck.

Referring now to the drawings wherein like reference characters designate corresponding parts throughout the several views, there is shown in FIGS. 1 and 2 a conventional forklift truck 10 having the usual lifting blades 12 and 14 extending forwardly therefrom. The handling device is indicated generally by reference numeral 16 and includes a pair of spaced support portions 18 and 20 in the form of tubular support members formed of steel or the like, the support members having open inner ends 18' and 20' respectively which are adapted to receive the lifting blades of the forklift truck.

FIG. 2 shows the handling device supported on the ground with the lifting blades in lowered position so that they can be fully inserted in the open ends of the support members 18 and 20 by driving the forklift truck forwardly from the position shown. FIG. 1 illustrates the handling device supported on the lifting blades which have been raised from the position shown in FIG. 22 so that the handling device is supported above the ground. An eye bolt 24 is welded to the side of support member 20, and one end of a thirty inch long grade 70 steel safety chain 26 is secured to the eyebolt. The opposite end of the chain is connected to a conventional grab hook 28. When the handling device is mounted on the forklift truck as shown in FIG. 1, the safety chain is wrapped around a vertical member 30 of the forklift truck with the grab hook engaging the chain 26, thereby preventing the handling device from sliding off of the lifting blades of the forklift truck.

Figure 3:
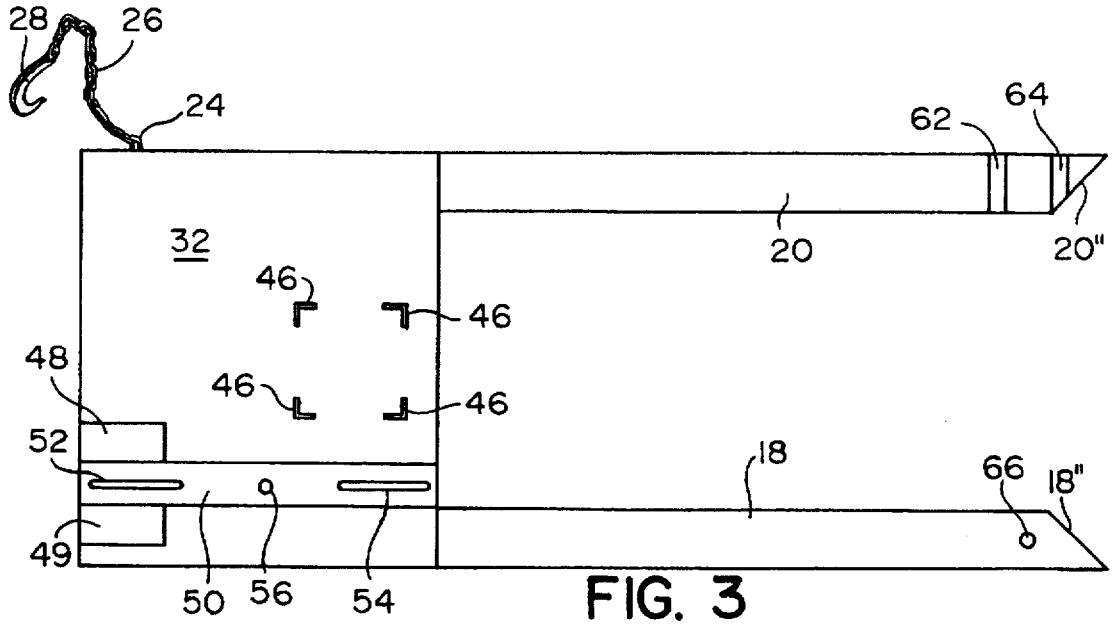
FIG. 3 is a top view of the handling device.
Figure 4:
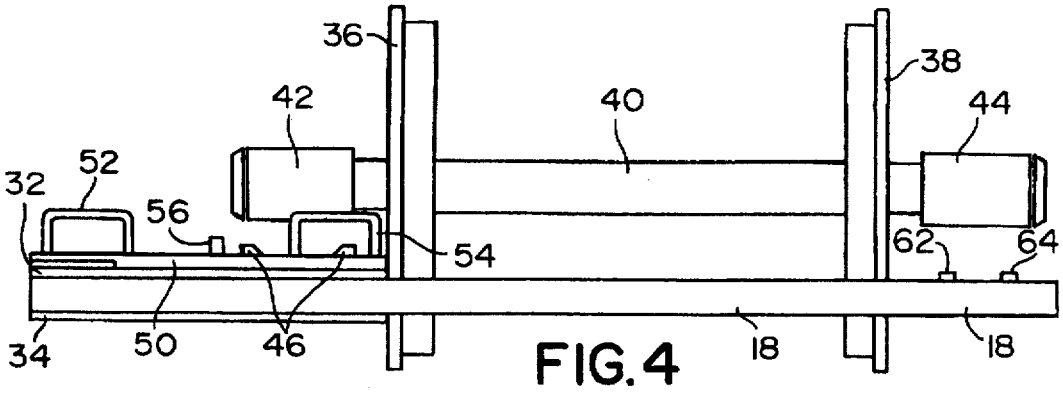
FIG. 4 is a side view of the device shown in FIG. 3 with a wheel assembly with larger wheels mounted on the device.

Referring to FIGS. 3 and 4, the support members 18 and 20 in a typical example have a length of about ten feet and have a height of about three inches and a width of about seven inches, the steel tubing having a thickness of about ⅜ inch. The outer ends 16" and 18" of the support members are tapered inwardly toward one another from the outer surfaces to the inner surfaces of the support members. These ends extend at about forty-five degrees to the outer sides of the support member and serve to guide wheel assemblies into proper position relative to the support members when the device is moved into operative position relative to a wheel assembly. The outer ends of the support members are preferably closed off by suitable steel plates welded to the outer end surfaces of the support members. The inner sides of the support members are positioned about thirty inches from one another.

Figure 6:
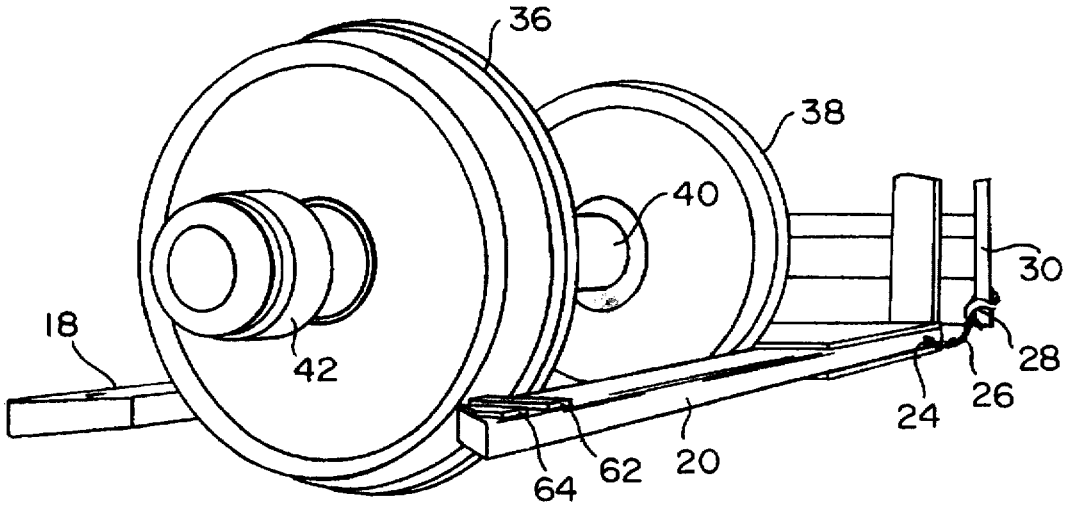
FIG. 6 is a top perspective view of the device showing a wheel assembly with larger wheels mounted thereon.

A pair of stop plates 32 and 34 are welded to the upper and lower surfaces respectively of the support members 18 and 20. These stop plates are also formed of steel and may have a thickness of about ¾ inch. When the handling device is moved into position to support a wheel assembly thereon, the handling device is moved forward until the forward edges of the stop plates engage the side of one of the wheels of the wheel assembly, thereby ensuring that the wheel assembly is properly positioned on the handling device. A large wheel assembly is shown as supported in such position on the handling device in FIGS. 4 and 6 with the wheels engaging the inner upper edges of the support members. The wheel assembly is of conventional construction and includes a pair of railway wheels 36 and 38 mounted on an axle 40 which has roller bearing races 42 and 44 disposed at the opposite ends thereof.

As seen most clearly in FIG. 3, support means for supporting a roller bearing race adapter is provided on the upper surface of stop plate 32 in the form of four similar right-angle brackets 46 formed of steel which are welded in place. Also disposed on the upper surface of stop plate 32 are a pair of spaced plates 48 and 49 which are welded in place and receive therebetween an adapter bar 50 formed of steel plate about one inch thick and being about forty-four inches long.

Figure 7:
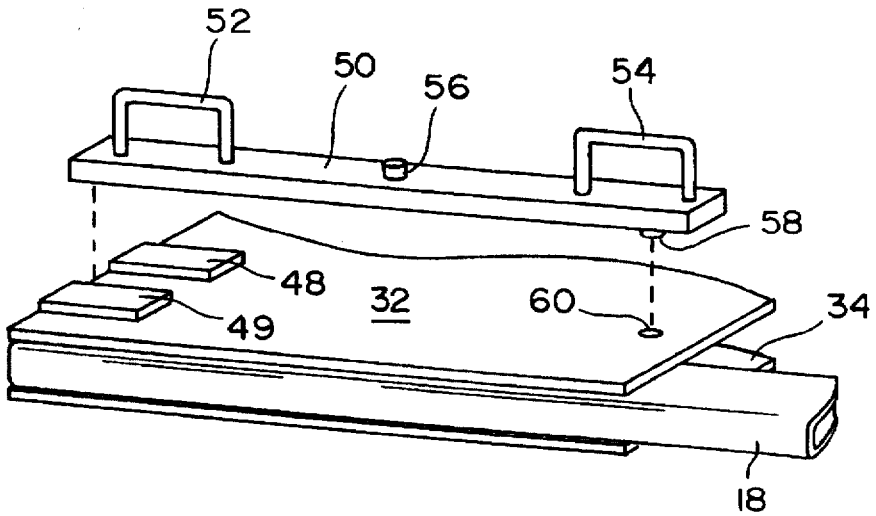
FIG. 7 is a top perspective exploded view showing a portion of the frame and the adapter bar.

Referring to FIG. 7, the adapter bar includes a pair of spaced handles 52 and 54 formed of round steel stock which are welded to the upper surface of the bar. A cylindrical stud 56 is welded to the midportion of the upper surface of the adapter bar and is about ¾ inch in diameter and has a length of about one and one-half inch. This stud is adapted to fit within a complementary hole in a roller bearing race adapter to support such adapter on the adapter bar as explained hereinafter. A pin 58 is welded to the undersurface of the adapter bar and extends downwardly therefrom. The pin is about ¾ inch in diameter and has a length of about one and one-half inch. The pin is received in a hole 60 formed through stop plate 32 when the adapter bar is in stored position with the adapter bar received between plates 48 and 49. Bars 48 and 49 and hole 60 provide a first retaining means for retaining the adapter bar in stored position.

Referring to FIG. 3, the outer end portion of support member 20 has a pair of narrow plates 62 and 64 welded to the upper surface thereof. Plates 62 and 64 are adapted to receive the adapter bar therebetween when a smaller wheel assembly is to be handled. The outer end portion of support member 18 is provided with a hole 66 formed through the upper wall of the support member for receiving pin 58 when the adapter bar is received between plates 62 and 64. Plates 62 and 64 and hole 66 provide a second retaining means for retaining the adapter bar in railway wheel assembly supporting position.

OPERATION

The handling device is first positioned on the lifting blades of a forklift truck as previously described and lifted to a desired height so as to clear the side of a railway track. Assuming that a wheel assembly having wheels with a diameter of 33, 36 or 38 inches is resting on the track and is ready to be removed, the support members are moved forwardly on either side of the wheels until a wheel of the assembly engages the stop plates. The handling device is then lifted upwardly by the forklift truck so that the wheels of the wheel assembly are supported in the position shown in FIGS. 4 and 6. The handling device is then raised further until the wheel assembly is raised off the track and the flanges of the wheels can clear the track. The forklift truck can then back up to carry the wheel assembly away from the track and thence to a remote location. The procedure can be reversed to carry a new wheel assembly into position on a track beneath a railway car.

During the above operation, the adapter bar is retained in the stored position on the stop plate 32 by the first retaining means discussed above. However, when it is desired to handle a wheel assembly having wheels 28 inches in diameter, the support members cannot support such wheels since the support members are thirty inches apart. Therefore, the adapter bar is raised by handles 52 and 54 from the stored position and then moved to the outer ends of the support members 18 and 20 so that the adapter bar is received between plates 62 and 64 on support member 20 with pin 58 extending downwardly into hole 66 in support member 18. In this position, the second retaining means serves to retain the the adapter bar is position for carrying wheel assemblies with smaller wheels.

Figure 5:
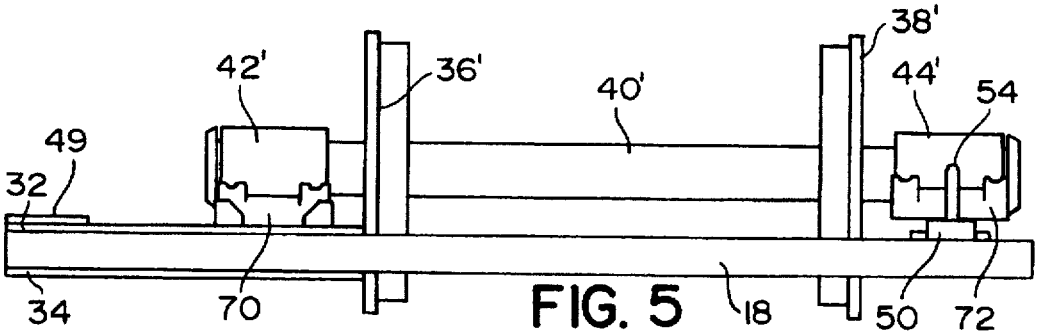
FIG. 5 is a view similar to FIG. 4 showing a wheel assembly with small wheels mounted on the device.
Figure 8:
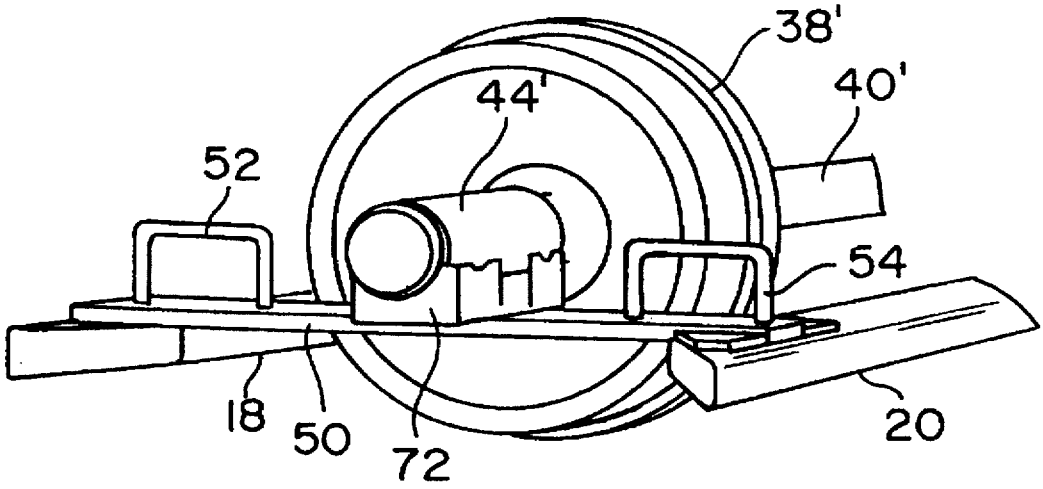
FIG. 8 is a top perspective view showing one end of a wheel assembly with small wheels supported on the adapter bar.
Figure 9:
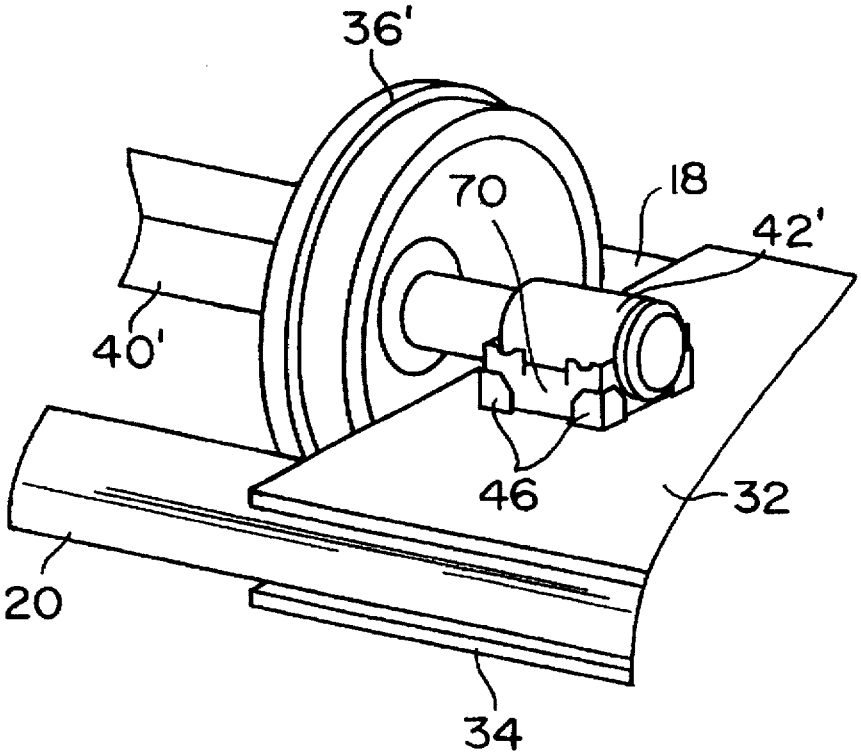
FIG. 9 is a top perspective view showing the opposite end of the wheel assembly shown in FIG. 8 with the opposite end supported on the stop plate of the frame.

As seen in FIGS. 5, 8 and 9, the components of a wheel assembly having smaller wheels includes a pair of wheels 36' and 38' mounted on an axle 40' having roller bearing races 42' and 44' disposed at opposite ends thereof.

When handling a wheel assembly having smaller wheels, the handling device as shown in FIG. 1 is moved into place such that the support members 18 and 20 extend on opposite sides of the wheel assembly. The adapter bar is then placed in position so as to be supported between the outer ends of the two support members. A first conventional roller bearing race adapter 70 is supported on stop plate 32 by support brackets 46, and a second conventional roller bearing race adapter 72 is supported on the adapter bar and held in place by stud 56 which extends upwardly from the adapter bar into a complementary hole formed in adapter 72. The handling device is then raised by the forklift truck so that adapter 70 supports bearing race 42' and adapter 72 supports bearing race 44' whereupon the wheel assembly may be removed from the track and transported to a desired location. This procedure may also be reversed for moving a new wheel assembly into position on the track.

Adapters 70 and 72 engage the lower parts of the bearing races as used in the invention which is upside down from the orientation of such adapters in normal use with a railway car wherein they rest upon the upper parts of the bearing races.

When it is again desired to handle wheel assemblies with larger wheels, the adapter bar is lifted and removed from the outer ends of the support members and again placed into its stored position.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A handling device for railway wheel assemblies comprising, a frame including a pair of spaced support portions for receiving a railway wheel assembly therebetween, said frame including receiving means for receiving the lift blades of a forklift truck to support the frame on the lift blades of a forklift truck, said frame including stop means for engaging a railway wheel assembly to limit relative movement between a railway wheel assembly and said frame, a removable adapter bar for supporting a railway wheel assembly, first retaining means for retaining said adapter bar in stored position adjacent said stop means, and second retaining means for retaining said adapter bar in railway wheel assembly supporting position adjacent said support portions and remote from said stop means.

2. A device as defined in claim 1 wherein said first retaining means includes a pair of spaced members supported on said stop means for receiving said adapter bar therebetween.

3. A device as defined in claim 2 wherein said first retaining means also includes a hole formed in said stop means, said adapter bar having a pin extending downwardly therefrom and being received in said hole in the stop means when the adapter bar is in stored position.

4. A device as defined in claim 1 wherein said second retaining means includes a pair of spaced members supported on one of said support portions for receiving said adapter bar therebetween.

5. A device as defined in claim 4 wherein said second retaining means also includes a hole formed in the other one of said support portions, said adapter bar having a pin extending downwardly therefrom and being received in said hole in the other one of said support portions when the adapter bar is in railway wheel assembly supporting position.

6. A device as defined in claim 1 including a safety chain having one end thereof connected to said frame, the other end of said chain being connected to a hook so that the chain can be secured to a member of a forklift truck having its lift blades received within said receiving means to ensure that the frame does not slide off of the lift blades of the forklift truck.

7. A device as defined in claim 1 including support means mounted on said stop means for supporting a roller bearing race adapter on said stop means.

8. A device as defined in claim 7 wherein said support means comprises a plurality of spaced brackets secured to said stop means.

9. A device as defined in claim 1 wherein said adapter bar has an upstanding stud secured thereto for supporting a roller bearing race adapter on said adapter bar.

10. A handling device for railway wheel assemblies comprising, a pair of elongated tubular support members each having an outer end and an opposite open end for receiving the lift blades of a forklift truck to support the device on the lift blades of a forklift truck, said support members being adapted to support a railway wheel assembly thereon, a stop plate fixed to said support members adjacent the open ends thereof for engaging a railway wheel assembly to limit relative movement between a railway wheel assembly and said support members, a removable adapter bar for supporting a railway wheel assembly, first retaining means for retaining said adapter bar in stored position on said stop plate and remote from said outer ends of the support members, and second retaining means for retaining said adapter bar in railway wheel supporting position on said support members adjacent said outer ends thereof and remote from said stop plate.

11. A device as defined in claim 10 wherein said first retaining means includes a pair of plates fixed to said stop plate for receiving said adapter bar therebetween.

12. A device as defined in claim 11 wherein said first retaining means also includes a hole formed in said stop plate, said adapter bar having a pin extending downwardly therefrom and being received in said hole in the stop plate when the adapter bar is in stored position.

13. A device as defined in claim 10 wherein said second retaining means includes a pair of spaced members fixed to one of said support members adjacent the outer end thereof for receiving said adapter bar therebetween.

14. A device as defined in claim 13 wherein said second retaining means also includes a hole formed in the other of said support members adjacent the outer end thereof, said adapter bar having a pin extending downwardly therefrom and being received in said hole in the other one of said support members when the adapter bar is in railway wheel assembly supporting position.

15. A device as defined in claim 10 including a safety chain having one end thereof connected to one of said support members, the other end of said chain being connected to a grab hook so that the chain can be secured to a member of a forklift truck having its lift blades received within the open ends of said support members to ensure that the device does not slide off of the lift blades of the forklift truck.

16. A device as defined in claim 10 including support means fixed to said stop plate for supporting a roller bearing race adapter on said stop plate.

17. A device as defined in claim 16 wherein said stop plate has an upwardly facing surface, said support means comprising a plurality of spaced brackets fixed to said upwardly facing surface.

18. A device as defined in claim 10 wherein said adapter bar has a midportion, and an upstanding stud secured to said midportion for supporting a roller bearing race adapter on said adapter bar.

19. A device as defined in claim 10 wherein said support members include inner and outer surfaces, the outer ends of said support members tapering inwardly toward one another from said outer surfaces to said inner surfaces.

* * * * *